United States Patent [19]

Katoh

[11] 4,229,511

[45] Oct. 21, 1980

[54] ELECTROPHOTOGRAPHY WITH UNIFORM EXPOSURE FOR RESIDUAL POTENTIAL

[75] Inventor: Tatuya Katoh, Yokohama, Japan

[73] Assignee: Ricoh Company, Ltd., Tokyo, Japan

[21] Appl. No.: 952,158

[22] Filed: Oct. 17, 1978

[30] Foreign Application Priority Data

Oct. 22, 1977 [JP] Japan ..... 52/126944

[51] Int. Cl.[3] ..... G03G 13/22; G03G 5/14

[52] U.S. Cl. ..... 430/55; 430/31; 430/126; 430/58

[58] Field of Search ..... 96/1 R, 1.4; 430/31, 430/55, 126

[56] References Cited

U.S. PATENT DOCUMENTS

| | | | |
|---|---|---|---|
| 3,337,339 | 8/1967 | Snelling | 96/1 R |
| 3,655,369 | 4/1972 | Kinoshita | 96/1 R |
| 3,776,627 | 12/1973 | Ohnishi et al. | 96/1 R X |
| 3,873,310 | 3/1975 | Bean | 96/1.4 |
| 4,047,945 | 9/1977 | Pfister et al. | 96/1.4 X |
| 4,071,361 | 1/1978 | Marushima | 96/1.4 |

*Primary Examiner*—Roland E. Martin, Jr.

*Attorney, Agent, or Firm*—Blanchard, Flynn, Thiel, Boutell & Tanis

[57] ABSTRACT

The present invention provides an electrophotographic process for producing copied images by repeating the respective steps of at least charging a layered photoconductor having a carrier generation layer and a carrier transport layer, in that order, on a light-transmissible electroconductive support, effecting image-wise exposure by way of one side of said layered photoconductor and developing subsequent thereto, in which the occurrence of stains on the ground of the image is minimized by uniformly applying light in an amount of exposure sufficient for substantially eliminating the residual potential resulting from said image-wise exposure by way of the other side of the layered photoconductor either simultaneously with the image-wise exposure or in the course of from the image-wise exposure to the development.

5 Claims, No Drawings

ELECTROPHOTOGRAPHY WITH UNIFORM EXPOSURE FOR RESIDUAL POTENTIAL

BACKGROUND OF THE INVENTION (a) Field of the Invention

The present invention relates to an electrophotographic reproduction process which renders it possible to eliminate the residual potential arising from repeated use of a layered photoconductor.

(b) Description of the Prior Art

In electrophotography, there is known the art of producing copied images by repeating the respective steps of charging a layered photoconductor for electrophotography obtained by providing a layer capable of generating electric charge when light is applied thereto (hereinafter called "carrier generation layer") and a layer capable of transporting the thus generated electric charge (hereinafter called "carrier transport layer"), in that order, on a light-transmissible electroconductive support (which element may be further provided with a barrier layer formed on said electroconductive support), effecting image-wise exposure by way of one side of the layered photoconductor and developing subsequent thereto, followed by transfer of the developed image if necessary. In this case, the surface of the layered photoconductor comes to have a potential due to the charging, and the potential of the exposed area (to wit, the non-image area) must be eliminated by the succeeding image-wise exposure. According to this art, however, there still remains a relatively high potential in the exposed area after the exposure, and this residual potential causes conspicuous stains on the resulting images and also constitutes a factor which disturbs the reproduction of continuous gradation.

Meanwhile, in the case where general single layer-type photosensitive elements, such as selenium-type photosensitive element, are employed as a countermeasure for preventing the occurrence of stains on the ground due to residual potential, it is usual to perform the development by applying a developing bias voltage of about 200 V to the photosensitive element. However, application of the same operation to the foregoing laminate-type layered photoconductors has proved to be insufficient for the purpose of eliminating the occurrence of stains on the ground. It is conceivable to raise said bias voltage to a desired value to cover this defect, but from the viewpoint of safety, there is a limit to the applicable voltage and, accordingly, this measure is very difficult to put to practical use.

SUMMARY OF THE INVENTION

The present invention provides an electrophotographic reproduction process which can prevent the occurrence of stains on the ground of the image due to residual potential in the aforesaid layered photoconductors to the utmost while ensuring safety of operation as well. In other words, the present invention provides an electrophotographic process for producing copied images through repetition of the respective processes of charging, image-wise exposure and development by employing the aforesaid layered photoconductors, which is characterized in that light is uniformly applied to the layered photoconductor in an amount of exposure sufficient for substantially eliminating the residual potential resulting from the image-wise exposure by way of the side opposite to the side subjected to the image-wise exposure simultaneously with the image-wise exposure or in the course of from the step of image-wise exposure to the step of development.

In the present invention, since it suffices that the residual potential that arises in a layered photoconductor can be eliminated from said layered photoconductor just prior to the development process, the application of light for the purpose of eliminating the residual potential can be performed either simultaneously with the generation of the residual potential, that is, during the image-wise exposure, or in the step of course of from the step of image-wise exposure to just prior to the development step. The side on which light is to be applied is the reverse of the side that is subjected to the image-wise exposure. Accordingly, in the case where the image-wise exposure has been effected on the carrier transport layer side, the application of light to eliminate the residual potential is performed on the light-transmissible electroconductive support side.

The application of light for eliminating the residual potential should be uniformly performed all over the side concerned. This application of light is for the purpose of eliminating the residual potential as a matter of course, but as it has an effect of lowering the surface potential of the image area at the same time, care should be taken lest this potential should become lower than that required. Excess lowering of the surface potential of the image area would result in copies having an image of low density. On the other hand, when the lowering of the surface potential of the non-image area is excessively controlled and elimination of the residual potential of the non-image area (or exposed area) is insufficient, prevention of the occurrence of stains on the ground would not be realized. Viewed from this point, the degree of the application of light for the purpose of eliminating the residual potential should be correlatively determined on the basis of the relation between the surface potential of the image area and the residual potential of the exposed area. It cannot be limited indiscriminately, but it suffices to be about equivalent to 1/20 to $\frac{1}{2}$ of the amount of exposure (in terms of lux.sec.) required for the image-wise exposure, and in order to obtain a copy which is satisfactory from the viewpoint of the density of image as well as the stain-free ground the image, it is desirably equivalent to 1/10 to $\frac{1}{3}$ of the amount of exposure (in terms of lux.sec.) required for the image-wise exposure.

The reason why the application of light in this way can eliminate the residual potential is yet to be clarified, but the present inventor conjectures as follows. That is, when thought is given to a case in which the holes are ready to move but the electrons are difficult to move within the carrier generation layer of a layered photoconductor, it seems that the electrons are trapped in said layer, and this condition constitutes a cause of the residual potential. When carriers are generated in the carrier generation layer by applying light all over the layered photoconductor in the foregoing condition by way of one side of the photoconductor, it is likely that these carriers recombine with the trapped electrons, thereby rendering it possible to eliminate the residual potential.

Subsequent to the application of light for the purpose of eliminating the residual potential, it is possible to perform a conventional developing operation.

The carrier generation layer provided on the light-transmissible electroconductive support comprises a carrier-generating pigment, and it can further comprise a binding resin and a plasticizer as occasion demands.

Besides, if necessary, it is possible to interpose a layer for preventing the injection of carrier in between said electroconductive layer and said carrier generation layer in order to check the dark decay. As the foregoing carrier generating pigment, any pigment is useful as far as it can generate carriers when light is applied thereto. For instance, organic pigments such as azo, xanthene, violanthrone, phthalocyanine, indigoid, perylene, indanthrone, etc. and inorganic pigments such as Se, Se-Te, As-Se, CdS, CdSe, CdTe, etc. are useful.

Further, as the foregoing binding resin, a variety of well-known resins are useful. Particularly, polyester resin, acrylic resin, silicone resin, novolak resin, ketone resins such as polyketone, polyvinyl ketone, etc. are preferable. Moreover, resins having photoconductivity intrinsically, such as poly-N-vinyl carbazole or derivatives thereof, are also useful as the binding agent. To cite other applicable binding agents, there are condensation resins such as polyamide, polyurethane, epoxide resin, polycarbonate, etc. and vinyl polymers such as polystyrene, polyacrylamide, etc. Generally speaking, resins having insulating property as well as adhesive property are all useful.

As applicable plasticizers, there can be cited paraffin halide, polybiphenyl chloride, dimethyl naphthalene, dibutyl phthalate, etc.

In the carrier transport layer provided on the carrier generation layer, there are contained a carrier-transportable material and, if necessary, a binding resin such as mentioned above.

To cite applicable carrier-transportable materials, as for high-molecular material, there are vinyl polymers such as poly-N-vinyl carbazole, halogenated poly-N-vinyl carbazole, polyvinyl pyrene, polyvinyl indoloquinoxaline, polyvinyl dibenzothiophene, polyvinyl anthracene, polyvinyl acridine, etc. and condensation resins such as pyrene-formaldehyde resin, bromopyrene-formaldehyde resin, ethyl carbazole-formaldehyde resin, chloroethyl carbazole-formaldehyde resin, etc., and as for low-molecular material (monomer), there are fluorenone, 2-nitro-9-fluorenone, 2,7-dinitro-9-fluorenone, 2,4,7-trinitro-9-fluorenone, 2,4,5,7-tetranitro-9-fluorenone, 4H-indeno[1,2-b]thiophene-4-one, 2-nitro-4H-indeno[1,2-b]thiophene-4-one, 2,6,8-trinitro-4H-indeno[1,2-b]thiophene-4-one, 8H-indeno[2,1-b]thiophene-8-one, 2-nitro-8H-indeno[2,1-b]thiophene-8-one, 2-bromo-6,8-dinitro-4H-indeno[1,2-b]thiophene, 6,8-dinitro-4H-indeno[1,2-b]thiophene, 2-nitro-dibenzothiophene, 2,8-dinitro-dibenzothiophene, 3-nitro-dibenzothiophene-5-oxide, 3,7-dinitro-dibenzothiophene-5-oxide, 4-dicyanomethylene-4H-indeno[1,2-b]thiophene, 6,8-dinitro-4-dicyanomethylene-4H-indeno[1,2-b]thiophene, 1,3,7,9-tetranitrobenzo[c]cinnoline-5-oxide, 2,4,10-trinitrobenzo[c]cinnoline-6-oxide, 2,4,8-trinitrobenzo[c]cinnoline-6-oxide, 2,4,8-trinitrothioxanthone, 2,4,7-trinitro-9,10-phenanthrene quinone, 1,4-naphthoquinonebenzo[a]anthracene-7,12-dione, 2,4,7-trinitro-9-dicyanomethylene fluorene, tetrachlorophthalic anhydride, 1-bromopyrene, 1-methyl pyrene, 1-ethyl pyrene, 1-acethyl pyrene, carbazole, N-ethyl carbazole, J-$\beta$-chloroethyl carbazole, N-$\beta$-hydroxyethyl carbazole, 2-phenyl indole, 2-phenyl naphthalene, 2,5-bis(4-diethyl aminophenyl)-1,3,4-oxadiazole, 2,5-bis(4-diethyl aminophenyl)-1,3,4-triazole, 1-phenyl-3-(4-diethyl aminostyryl)-5-(4-diethyl aminophenyl)-pyrazoline, 2-phenyl-4-(4-diethyl aminop;anyl)-5-phanyl oxazole, triphenyl amine, tris(4-diethyl aminophenyl)methane, 3,6-bis(dibenzylamino)-9-ethyl carbazole, etc. These carrier-transportable materials are employed either individually or upon mixing two or more of them together.

According to the present invention, as it is possible to eliminate the residual potential by virtue of application of light on one side of a layered photoconductor and that application of light in an amount of exposure less than necessary for the image-wise exposure, the occurrence of stains on the ground of image can be prevented without worrying about the question of safety of operation, and the deterioration of the density of the image can also be prevented only by selecting the amount of exposure in applying light.

DESCRIPTION OF THE PREFERRED EMBODIMENTS

Comparative Example

A carrier generation layer (4.6$\mu$ in thickness) comprising poly-N-vinyl carbazole and polyester resin at the weight ratio of 10:1 and further containing 20% by weight of the following azo pigment relative to said poly-N-vinyl carbazole was provided on a light-transmissible electroconductive support prepared by forming a transparent electroconductive layer of chromium on the surface of a transparent base plate (made of polyethylene phthalate):

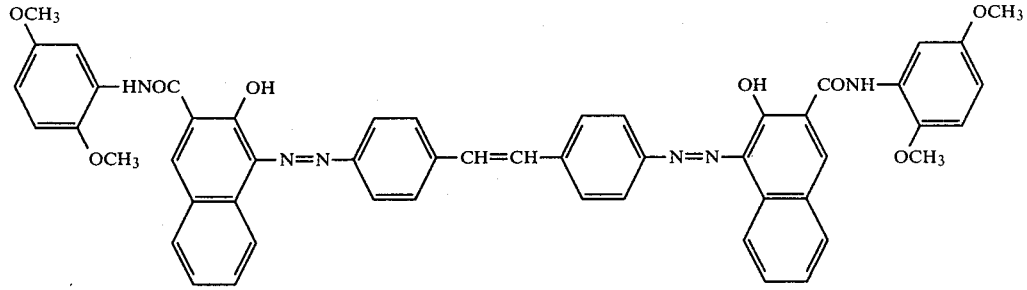

Next, a carrier transport layer (16.3$\mu$ in thickness) composed of 2,5-bis(4-diethyl aminophenyl)-1,3,4-oxadiazole and polycarbonate at the weight ratio of 1:1 was provided on the foregoing carrier generation layer.

Subsequently, the resulting layered photoconductor was charged with negative electricity, and light was applied thereon by means of a tungsten lamp when the surface potential Vo of the layered photoconductor became −800V. When the amount of exposure was set at 20 lux.sec., the surface potential of the exposed area ($V_L$) attained −220V. When image-wise exposure was effected on the carrier transport layer side under this condition and development was performed by applying developing bias voltage of −200V on the layered photoconductor and using a magnet brush, there was produced an image having a stained ground.

EXAMPLE 1.

When charging and image-wise exposure were performed on a layered photoconductor in the same way as in the foregoing Comparative Example and thereafter light was uniformly applied in an amount of exposure of 5 lux.sec. corresponding to $\frac{1}{4}$ of the amount of image-wise exposure all over the element by way of the light-transmissible electroconductive support side, the surface potential of the image-wise exposed area ($V_L$) became −40V, and as a result of development with a magnet brush, there was obtained a clear-cut copied image free of stains on the ground.

EXAMPLE 2.

When charging and image-wise exposure were performed on a layered photoconductor in the same way as in Example 1 and thereafter light was uniformly applied in an amount of exposure of 10 lux.sec. corresponding to $\frac{1}{2}$ of the amount of image-wise exposure all over the element by way of the light-transmissible electroconductive support side, the surface potential of the image-wise exposed area ($V_L$) became 0, and as a result of development conducted in the same way as in Example 1, there was obtained a copied image free of stains on the ground. However, because of the lowering of the surface potential of the image area, the density of the image was somewhat lower than that in Example 1.

EXAMPLE 3.

When charging and image-wise exposure were performed on a layered photoconductor in the same way as in Example 1 and thereafter light was uniformly applied in an amount of exposure of 1 lux.sec. corresponding to 1/20 of the amount of image-wise exposure all over the element by way of the light-transmissible electroconductive support side, the surface potential of the image-wise exposed area ($V_L$) became −160V, and as a result of development conducted in the same way as in Example 1, there was obtained a copied image having somewhat stained ground compared with that in Example 1 though the density of image was high.

What is claimed is:

1. An electrophotographic copying process, using an electrophotographic element consisting essentially of a light-transmitting electroconductive support, a charge carrier generating layer on said support and a charge carrier transport layer on said charge carrier generating layer, which process consists essentially of the steps of: applying a uniform electrostatic charge of one polarity to said electrophotographic element; then imagewise exposing said electrophotographic element by applying a light image onto one outer surface of said electrophotographic element to form an electrostatic latent image on said electrophotographic element; simultaneously with or after said imagewise exposing step, uniformly exposing said electrophotographic element by applying light onto the entirety of the opposite outer surface of said electrophotographic plate to substantially eliminate the residual potential in said electrophotographic element, the amount of exposure, measured as lux.sec, applied in said step of uniformly exposing being from 1/20 to $\frac{1}{2}$ the amount of exposure, measured as lux.sec, applied in said step of imagewise exposing; after said step of uniformly exposing, then developing said latent image and transferring the developed image to another substrate.

2. A process as claimed in claim 1 for obtaining multiple copies in which the second and succeeding copies are produced by repeating said steps of developing and transferring.

3. A process as claimed in claim 1 or claim 2, in which said step of imagewise exposing is performed by applying said light image directed onto the outer surface of said charge carrier transport layer and said step of uniformly exposing is performed by applying light directed onto the outer surface of said light-transmitting electroconductive support.

4. A process as claimed in claim 1 or claim 2 in which the amount of exposure, measured as lux.sec, applied in said step of uniformly exposing is from 1/10 to $\frac{1}{3}$ the amount of exposure, measured as lux.sec, applied in said step of imagewise exposing.

5. A process as claimed in claim 3 in which the amount of exposure, measured as lux.sec, applied in said step of uniformly exposing is from 1/10 to $\frac{1}{3}$ the amount of exposure, measured as lux.sec, applied in said step of imagewise exposing.

* * * * *